US007828399B1

(12) United States Patent
Bass

(10) Patent No.: US 7,828,399 B1
(45) Date of Patent: Nov. 9, 2010

(54) UNIVERSAL LOCKER SYSTEM

(75) Inventor: Kenneth A. Bass, Chapin, SC (US)

(73) Assignee: Partition System Inc., Columbia, SC (US)

( * ) Notice: Subject to any disclaimer, the term of this patent is extended or adjusted under 35 U.S.C. 154(b) by 333 days.

(21) Appl. No.: 12/041,278

(22) Filed: Mar. 3, 2008

(51) Int. Cl.
*A47B 53/02* (2006.01)

(52) U.S. Cl. ..... 312/199; 312/213; 312/109

(58) Field of Classification Search ..... 312/198–200, 312/326, 329, 263, 265.5, 213, 109
See application file for complete search history.

(56) References Cited

U.S. PATENT DOCUMENTS

| | | | | |
|---|---|---|---|---|
| 3,550,981 | A * | 12/1970 | Cohen | 312/198 |
| 3,819,246 | A * | 6/1974 | List | 312/265.1 |
| 4,073,554 | A * | 2/1978 | Oder et al. | 312/199 |
| 4,289,363 | A * | 9/1981 | Andersson et al. | 312/257.1 |
| 4,836,626 | A * | 6/1989 | Taylor et al. | 312/257.1 |
| 4,893,884 | A * | 1/1990 | Tsuchida et al. | 312/107 |
| 5,310,254 | A * | 5/1994 | Dallaire | 312/213 |
| 5,344,636 | A | 9/1994 | Miyata | |
| 5,372,415 | A * | 12/1994 | Tisbo et al. | 312/108 |
| 6,384,128 | B1 | 5/2002 | Wadahara et al. | |
| 6,479,560 | B2 | 11/2002 | Freitag et al. | |
| 6,596,893 | B2 | 7/2003 | Nakacho et al. | |
| 6,793,299 | B2 * | 9/2004 | Newberry et al. | 312/199 |
| 6,902,797 | B2 | 6/2005 | Pollock et al. | |
| 6,932,443 | B1 * | 8/2005 | Kaplan et al. | 312/213 |
| 7,041,723 | B2 | 5/2006 | Kimura | |
| 7,211,529 | B2 | 5/2007 | Kim et al. | |
| 7,232,856 | B1 | 6/2007 | Campbell et al. | |
| 7,250,453 | B2 | 7/2007 | Sakuma et al. | |
| 7,524,002 | B2 * | 4/2009 | Punzel et al. | 312/217 |
| 2003/0175497 | A1 | 9/2003 | Kobe et al. | |
| 2005/0062371 | A1 * | 3/2005 | DeGabriele et al. | 312/213 |
| 2005/0281999 | A1 | 12/2005 | Hofmann et al. | |
| 2006/0029788 | A1 | 2/2006 | Lovell et al. | |
| 2006/0046034 | A1 | 3/2006 | Schober | |
| 2006/0053738 | A1 | 3/2006 | Jaffee | |
| 2007/0194289 | A1 | 8/2007 | Anglin et al. | |
| 2007/0208114 | A1 | 9/2007 | Mawatari et al. | |
| 2007/0251572 | A1 | 11/2007 | Hoya et al. | |
| 2007/0272118 | A1 | 11/2007 | Kashani et al. | |

FOREIGN PATENT DOCUMENTS

| | | | | |
|---|---|---|---|---|
| DE | 3300736 | A1 * | 7/1984 | 312/198 |
| GB | 2033212 | A * | 5/1980 | 312/198 |

* cited by examiner

*Primary Examiner*—Hanh V Tran
(74) *Attorney, Agent, or Firm*—Michael A. Mann; Nexsen Pruet, LLC

(57) ABSTRACT

A universal locker system that enables different sizes of lockers for custom configuration of a row of lockers. The number of lockers using a common housing may be one, two, three, four or six. Also, lockers with taller and shorter portions can be accommodated. A universal housing and universal, segmented hinge enable insertion of dividers at pre-selected elevations in the housing and installation of independently operable locker doors covering the distance between the pre-selected elevations and thus the opening between the dividers to create individual lockers from portions of the universal housing. The dividers thereby serve as the top of the locker below and the bottom of the locker above. Special dividers with two elevations may alternatively be inserted to create lockers having taller portions and shorter portions.

10 Claims, 8 Drawing Sheets

250
230
256
254
266
274
252
260
282
258
272
268
260
258
280

230
250
256
254
266
274
252
258
282
260
272
268
258
260
280

UNIVERSAL LOCKER SYSTEM

CROSS REFERENCE TO RELATED PATENTS

The present application is related to application Ser. No. 12/041,234 filed Mar. 3, 2008, in that all four applications are commonly owned and are directed to related subject matter Priority is claimed to the earliest filed of these other applications.

BACKGROUND OF THE INVENTION

Lockers are used in schools, gymnasiums, fitness centers, sports complexes, and work places for individuals to store items temporarily. School students may use a locker to store coats and books, for example, until needed. Lockers used in these generally public facilities are subject to abuse and may provide additional surfaces for the spread of diseases, particularly if the lockers are shared or used serially by several individuals.

Additionally, schools and other public places may have limited budgets and must spend public money wisely, buying the most cost-effective lockers available. Cost-effectiveness is a function of actual cost, installation cost, and durability. Fundamentally, of course, the design of the locker must be suitable for its intended purpose.

Thus, there remains a need for improvements in lockers to make them better suited for the particular uses to which they will be put, easier to install and maintain, more reliable and durable.

SUMMARY OF THE INVENTION

The present invention is a universal locker system that includes a universal locker housing configured to be easily subdivided into smaller (i.e., shorter) individual lockers and into lockers that accommodate both taller and shorter items. Each locker of the present locker system has a door that opens smoothly and easily and fully with a simple, lockable latch and hinge system.

The present locker system can be configured for larger and smaller lockers and each locker can be customized with full depth and partial depth shelving. A single set or bank of lockers can be composed of individual lockers of more than one size, as needs dictate. In one configuration, the present locker may have a left and a right portion behind a single door with one portion being taller than the other for longer items such as coats and a second portion being shorter for books or shoes, for example.

The latch mechanism carried by the locker door unlatches the locker door from the locker housing in one smooth lifting movement of the latch, thereby allowing the door to the housing to be opened.

The present locker door is attached to the present locker housing with a multi-section, piano-type hinge and is configured so that the door opens wide even if there is an adjacent locker. The present hinge, as a single hinge for a locker housing also permits the door of the locker to open even if that door is one of a stack of two, three, four or six doors mounted to the same housing.

The locker panel material is made of polymeric, thermoplastic material formed from thin (i.e., ¼-1½ inch thick) panels which may be impregnated with an anti-microbial agent and/or contain a fire retardant. Hardware, of metal, is coated with an anti-microbial agent. Accordingly, growth of bacteria, fungi, molds and mildew are resisted by the present locker.

The present locker system thus is a practical solution for a wide variety of needs, particularly in schools and other public and commercial facilities. The present locker can be configured to meet needs for different size lockers even within the same row of lockers, its door opens wide without interfering with adjacent lockers, its latch operates simply but yet securely latches the door to the locker housing, and the materials of which the locker is made resist molds, mildew, bacteria and fungus growth.

Those skilled in the art of locker design will understand from a careful reading of the Detailed Description of Preferred Embodiments accompanied by the following drawings other features and advantages of the present invention.

DETAILED DESCRIPTION OF PREFERRED EMBODIMENTS

The present invention is universal locker system that allows different size and shape lockers to be set up with minimal effort because of the modular form of the locker housing and hinge, as will not be described.

Figure 1:
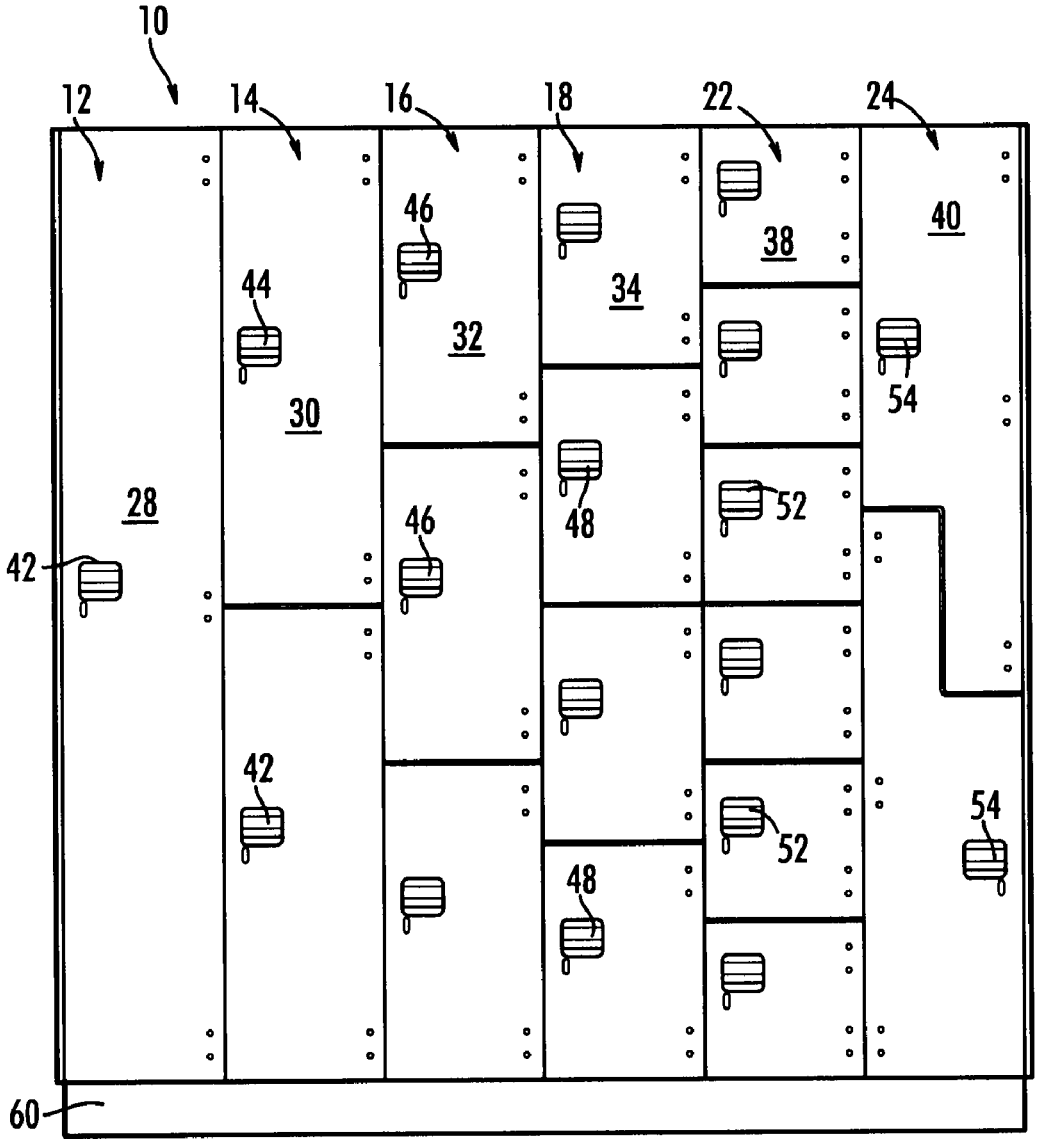
FIG. 1 shows a front view of a representative set of lockers of different sizes and shapes, with doors closed, according to a preferred embodiment of the present invention.
Figure 2:
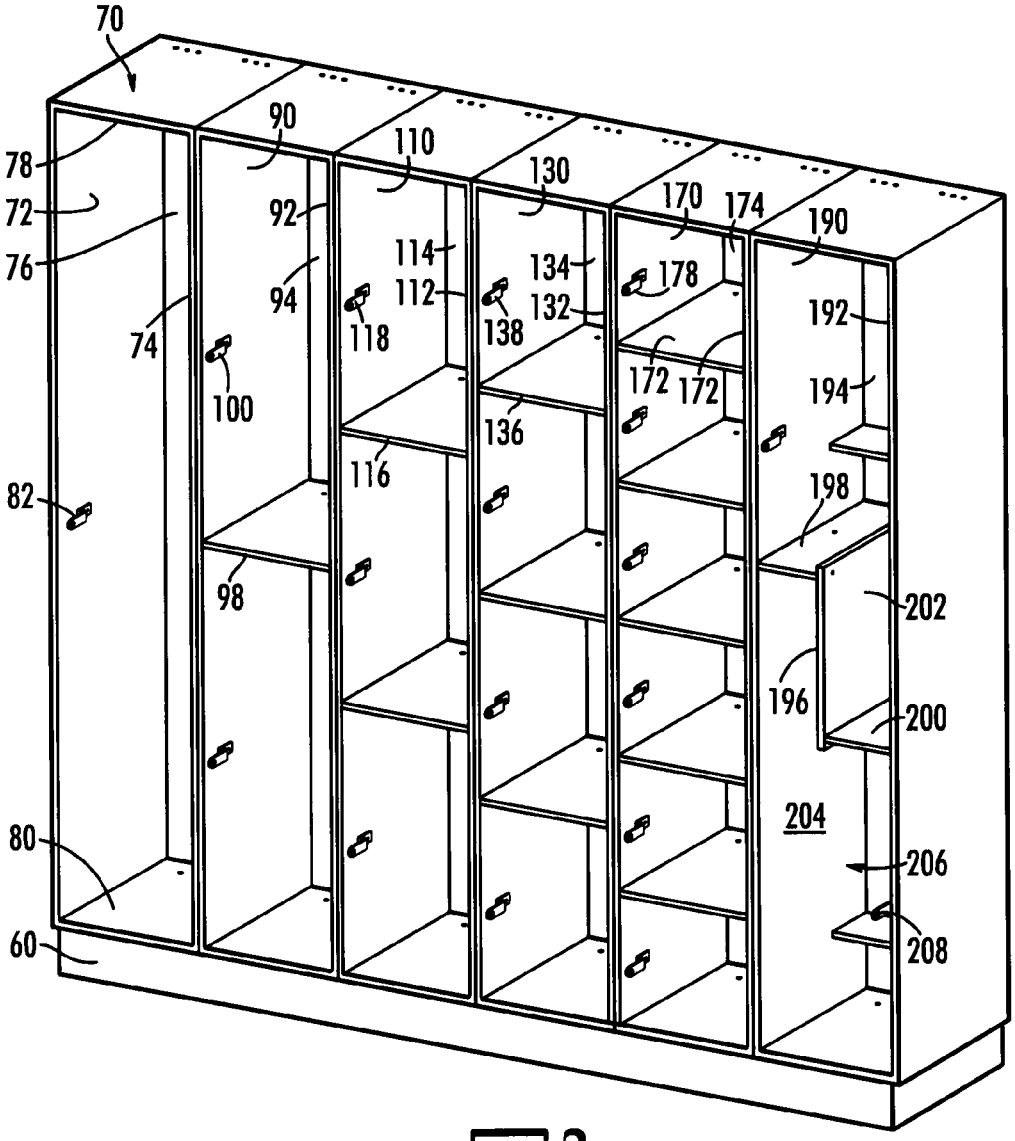
FIG. 2 is a perspective view of the set of lockers of FIG. 1, with doors removed, according to a preferred embodiment of the present invention.

Referring now to FIGS. 1 and 2, there is shown a set of lockers, generally indicated by the reference number 10. The illustrative set 10 includes a full-length (height) locker 12, two stacked half-height lockers 14, three stacked third-height lockers 16, four stacked quarter-height lockers 18, six stacked sixth-height lockers 22 and two stacked dual-height lockers 24 arranged in a bank or row of lockers.

Set 10 is illustrative of the different sizes and shapes of lockers of the present invention but the use of various locker sizes and shapes is not required and the arrangement shown is not a required arrangement. For example, the present hinge can be used with a bank of full length lockers 12 or a set of sixth height lockers 22. Also the number of lockers illustrated in the row is simply for illustration and is not intended to be a limiting number. For example, although six locker positions are illustrated in the row from left to right, there could be many more or fewer lockers in the row.

Each locker 12, 14, 16, 18, 22, 24 has a door 28, 30, 32, 34, 38, 40, respectively carrying a handle 42, 44, 46, 48, 52, 54, respectively, as seen in FIG. 1, which handle will be described more fully below, and set 10 is preferably set on a recessed base 60.

FIG. 2 shows lockers 12, 14, 16, 18, 22, 24 with doors 28, 30, 32, 34, 38, 40, removed revealing the interiors of each locker. Note that locker 12 comprises a housing 70 defining an enclosure with a left wall 72, a right wall 74, a rear wall 76, a top 78 and a bottom 80. Locker 12 also has a hasp 82 used in connection with latch 42. Left and right walls 72, 74, are formed to receive a divider at one of plural pre-selected heights between top 78 and bottom 80 so that the divider may be supported by the left and right walls 72, 74 at any of the pre-selected heights.

Lockers 14 have a common left wall 90, a common right wall, 92, a common rear wall 94, but share a divider 98 that serves as the top of the lower locker 14 and the bottom of the upper locker 14. Each locker 14 has a hasp 100.

Similarly, lockers 16 have a common left wall, 110, a common right wall 112, a common rear wall 114 and share two dividers 116, each divider 116 forming the top of a lower locker 16 and the bottom of an upper locker 16. Each locker 16 has a hasp 118.

Lockers 18 have a common left wall 130, a common right wall 132, a common rear wall 134, but share three dividers 136, each divider 136 forming the top of a lower locker 18 and the bottom of an upper locker 18. Each locker 18 has a hasp 138.

Lockers 22 have a common left wall 170, a common right wall 172, a common rear wall 174, but share five dividers 176, each divider 176 forming the top of a lower locker 22 and the bottom of an upper locker 22. Each locker 22 has a hasp 178.

Lockers 24 have a common left wall 190, a common right wall 192, a common rear wall 194, but share a divider 196 that forms the top of a lower locker 24 and the bottom of an upper locker 24. Divider 196 as shown is not flat but has a roughly "Z" shape with an upper level 198 and a lower level 200 joined by a connector 202 to define each locker 24 to have a taller portion 204 for storing longer or taller items such as jackets or pants, and a shorter portion 206 for storing shorter items such as books and shoes. Each locker 24 has a hasp 208.

Figure 3:
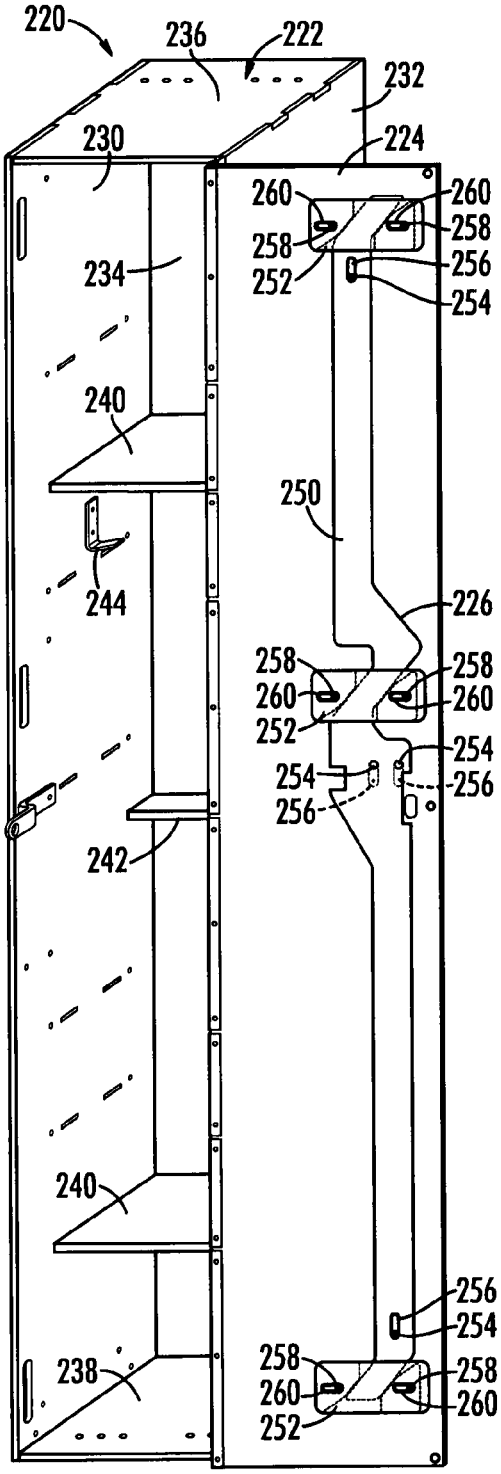
FIG. 3 is a perspective view of a tall locker with its door opened and the latch lifted, according to a preferred embodiment of the present invention.
Figure 4:
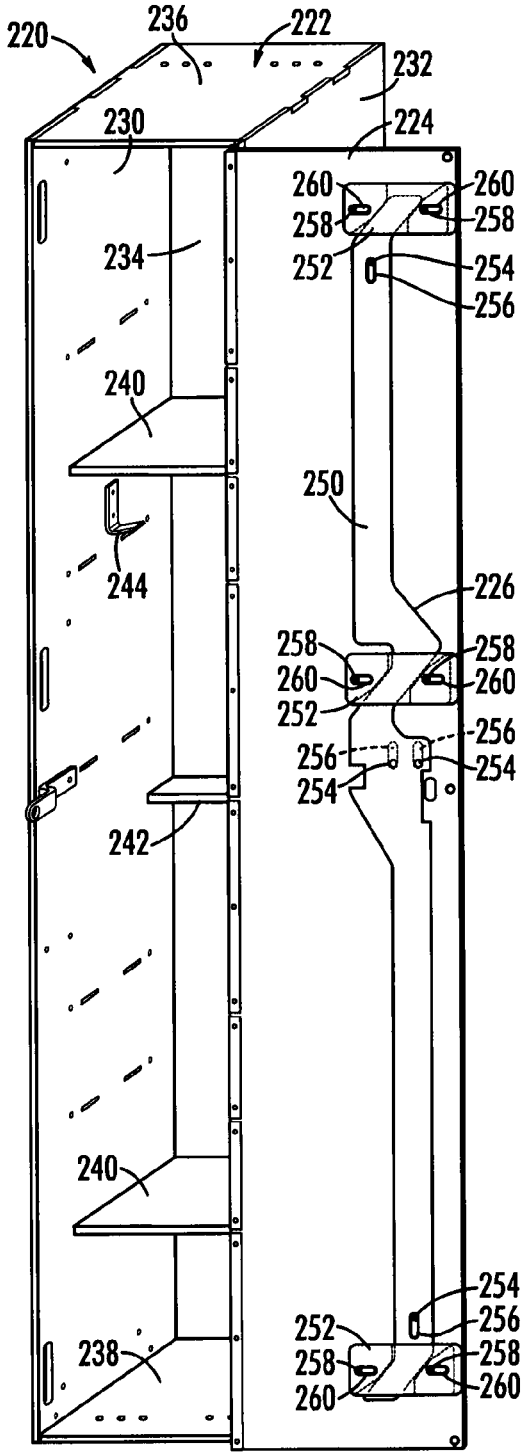
FIG. 4 is a perspective view of the tall locker of FIG. 3 with the latch in its rest position, according to a preferred embodiment of the present invention.

FIGS. 3 and 4 both illustrate a locker 220 with a housing 222 and its open door 224. Housing 222 is a universal housing in that it can be used for a locker configuration with one, two, three, four, six or dual height locker doors. In FIG. 3, locker 220 has a latch bar 226 in the unlatched position; in FIG. 4, locker 220 has latch bar 226 in the latched position. Latch bar 226 is sized according to the height of locker 220. If locker 220 were one of a stack of six lockers formed from the same housing 222, latch bar 226 would be correspondingly shorter.

Locker 220, as shown, is a full height locker, having a universal left wall 230, a universal right wall, 232, a universal rear wall 234, a universal top 236 and a universal bottom 238, and is in addition outfitted with two partial-depth universal shelves 240 and one universal "vanity", shelf 242 plus a hook 244 for hanging clothes but is otherwise identical to locker 12. The term universal is used to mean a part of locker 220 that will be the same for the present locker system regardless of whether it is a full height locker or a partial height locker.

Door 224 as depicted in FIGS. 3 and 4 is the inside of door 28 of FIG. 1 and has a latch bar 250 with three lateral lock bars 252. Latch bar 250 is constrained to move only up and down by four latch bar guides 254 attached to door 224 and that ride in slots 256 formed in latch bar 250; lateral lock bars 252 are constrained vertically but allowed to slide horizontally by latch guides 260 that ride in slots 262 in latches 252. Comparing FIGS. 3 and 4 shows that latch bar 250 is lower in FIG. 4 than in FIG. 3 and lateral lock bars 252 are all slid to the rightmost, latched position, in FIG. 4 from the leftmost, unlatched position in FIG. 3.

Figure 5:
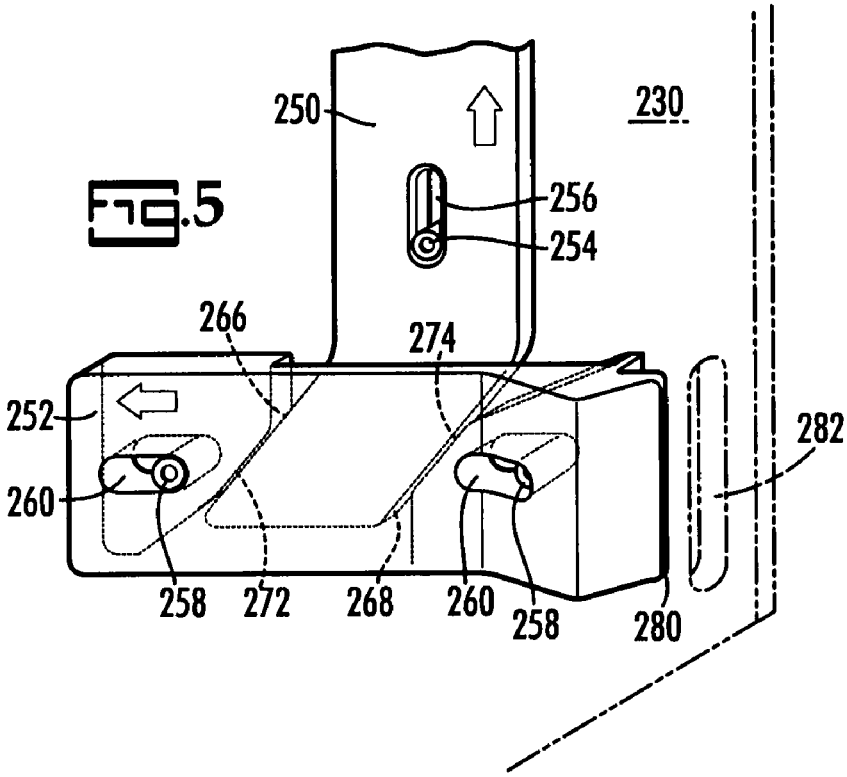
FIG. 5 is a detailed view of a bottom latch bracket and a lowermost portion of the latch bar with the latch lifted to remove latch bracket from the latch opening in the locker housing, as shown in FIG. 3, according to a preferred embodiment of the present invention.
Figure 6:
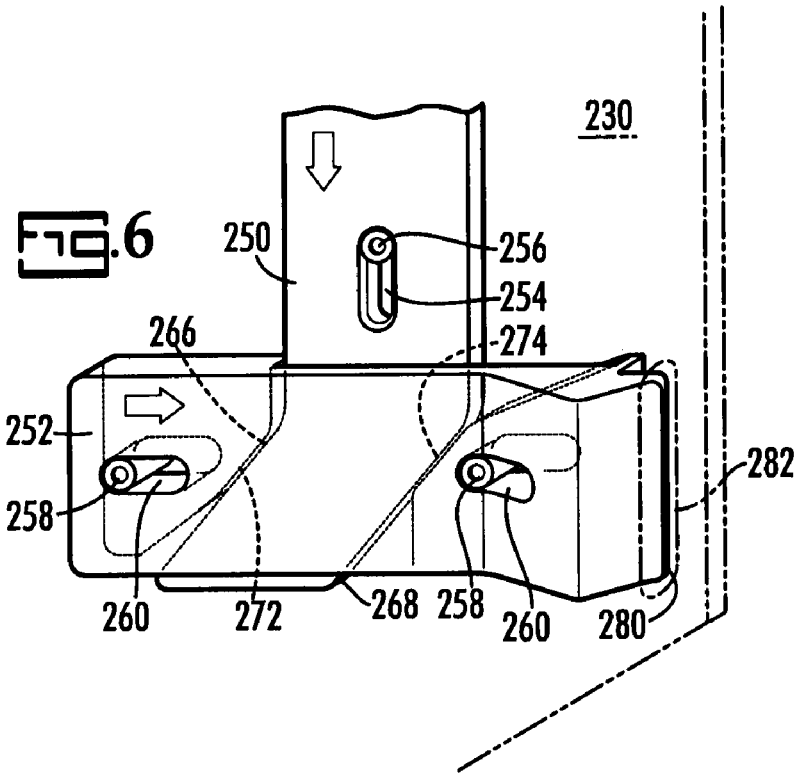
FIG. 6 is a detailed view of a bottom latch bracket and a lowermost portion of the latch bar with the latch at rest to move latch bracket into the latch opening in the locker housing, as shown in FIG. 4, according to a preferred embodiment of the present invention.

Examination of the shape of latch bar 250 and its interaction with lateral lock bars 252 and, in particular, in connection with FIGS. 5 and 6, which shows the bottom of latch bar 250 and the lowermost lateral lock bar 252, will reveal their operation.

The handle 42 on the front of door 28 lifts from a lower, latched position to an upper, unlatched position. As it does, latch bar 250 is raised but is guiding by latch bar guides 254, two of which are in the middle of latch bar 250 and one at each end of latch bar 250. Latch bar guides 254 extend through latch bar guide slots 256 which permit limited vertical movement of latch bar 250 but permit no horizontal movement. Vertical movement is defined in this case as parallel to the long dimension of locker 220; horizontal movement is defined as perpendicular to the long dimension of locker 220. When locker 220 is in its normal orientation, vertical movement of latching bar 250 is up and down (perpendicular to the plane of the surface locker 220 is standing on) rather from side to side, Lateral lock bars 252 may move horizontally only, not vertically. Lateral lock bars 252 are held to door 224 by lateral lock bar guides 258 that extend through lateral lock bar guide slots 260 that control horizontal movement and prevent vertical and diagonal movement.

Referring to FIGS. 5 and 6, latch bar 250 is angled to form camming surfaces 266, 268, that, when latch bar 250 is moved vertically upward, push against cammed surfaces 272, 274, respectively, of lateral lock bars 252 to cam lateral lock bars 252 from the latched position (FIG. 6) in which a toe 280 formed on the end of lateral lock bar 252 is in a slot 282 in left wall 230 of housing 222, to an unlatched position (FIG. 5) where a toe 280 of lateral lock bar 252 is moved clear of slot 282 and door 224 is then free to be opened.

Figure 7:
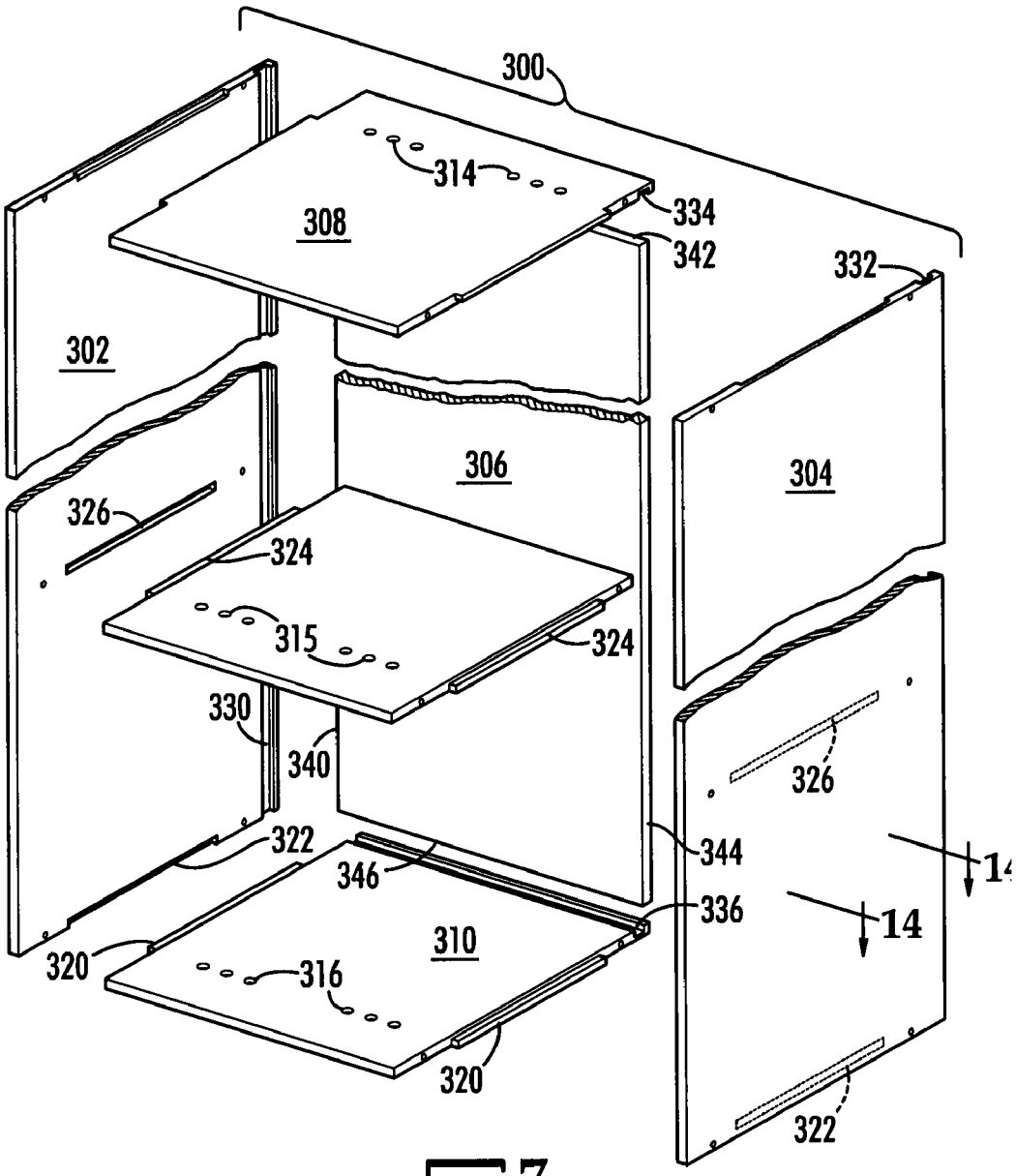
FIG. 7 is a perspective, exploded view of a locker housing with one shelf, according to a preferred embodiment of the present invention.

FIG. 7 illustrates how the present locker housing 300 is assembled from pre-cut panels to form universal components for any of lockers 12, 14, 16, 18, 22, or 24 shown in FIGS. 1 and 2. Housing 300 shown in FIG. 7 includes a common left wall 302, a common right wall 304, a common rear wall 306, a top 308, a bottom 310 and a divider 312 when housing 300 is to be formed in to, say, a half-height locker 14, or one of the other less-than-full-height lockers shown in FIGS. 1 and 2. Note vent holes 314, 315, 316, in top 308, divider 312, and bottom 310, respectively, Notice in FIG. 7 the use of mortise and tenon joining construction to inter-connect bottom 310 and divider 312 to common left wall 302 and common right wall 304. Bottom 310 has a tenon 320 on each side (left and right) to seat into mortises 322 formed in common left wall 302 and common right wall 304. Similarly, divider 312 has a tenon 324 on each side (left and right) to seat into mortises 326 formed in common left wall 302 and common right wall 304. Single or multiple mortise and tenon combinations can be used for each joint, as desired. Mortise and tenon joining construction distributes the load of the shelf over the width of the tenon rather than on a few screws and thus provides better holding.

Tongue and groove joining techniques are used to join common rear wall 306 to common left wall 302, common right wall 304, top 308 and bottom 310. Grooves 330, 332, 334, 336, are formed in common left wall 302, common right wall 304, top 308, and bottom 310, respectively, for the left, right, top and bottom edges 340, 342, 344, 346 edges of common rear wall 306. The assembled housing 300 is then held together with screws or other suitable fasteners preferably inserted in to pre-drilled clearance holes.

As shown in FIGS. 3 and 4, all mortises and fastener holes can be formed at the factory for every possibly combination of locker height and shelf arrangement whether they are to be used or not, to preserve flexibility of the end user to modify the locker arrangement at a later time.

Figure 8:
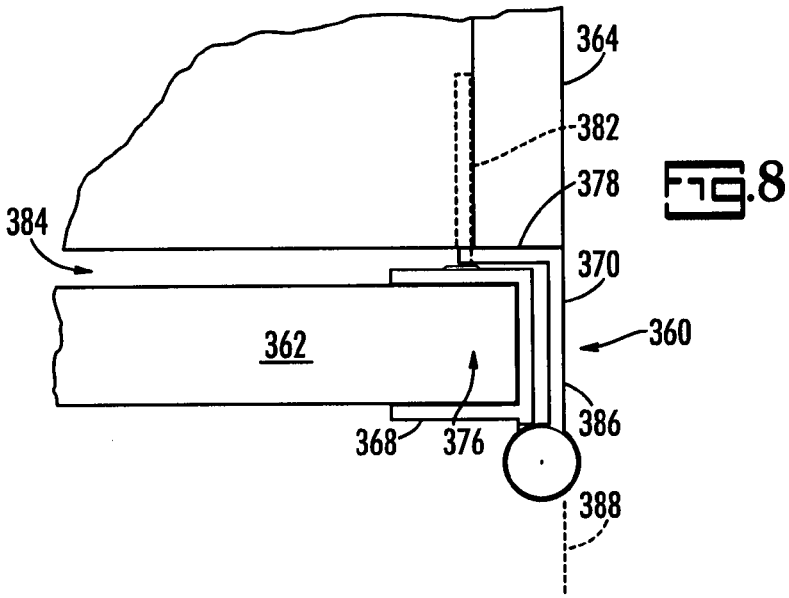
FIG. 8 is a top, detailed view of a hinge connecting a closed door to a locker housing, according to a preferred embodiment of the present invention.
Figure 9:
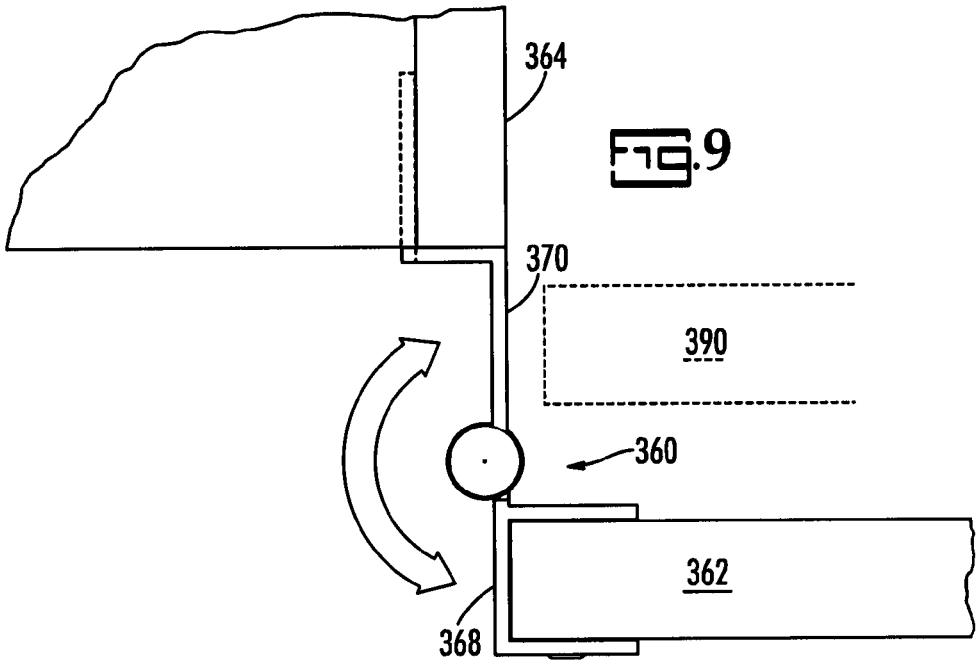
FIG. 9 is a top, detailed view of the hinge of FIG. 8 connecting an open door to a locker housing, according to a preferred embodiment of the present invention.
Figure 10:
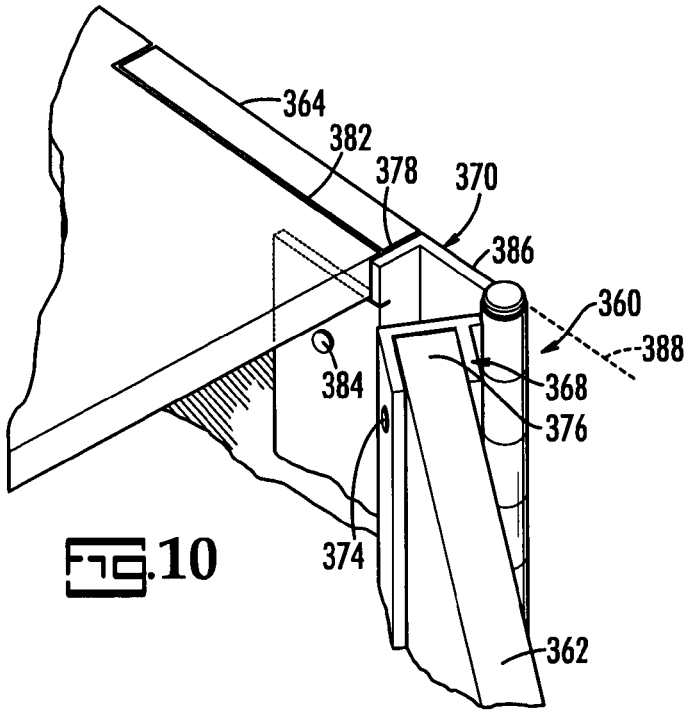
FIG. 10 is a top, perspective view of the hinge of FIGS. 8 and 9 connecting a partially opened door to a locker housing, according to a preferred embodiment of the present invention.

FIGS. 8, 9, and 10 illustrate a hinge 360 for holding a door 362 to a housing 364 to form the present locker. Hinge 360 has two connecting sides, a door connecting side 368 and a housing connecting side 370. Door 362 is inserted into a channel 376 formed in door connecting side 368 and secured in that channel 376 by any conventional means such as using bolts 374, but preferably headed barrel bolts.

Housing connecting side 370 crosses the front edge 378 of a wall 380 and wraps around the interior face 382 of housing 364, and can then be fastened thereto by convenient means, including bolts 384, preferably headed barrel bolts. An extension 386 of housing connecting side extends from front edge 378 by an amount slightly more than the width of channel 376 so that door connecting side 368 and housing connecting side 370 are pivotally joined in front of door 362 and within the envelop 388 defined by wall 380. Thus configured, and as illustrated by a comparison of FIGS. 8 and 9, door 362 can be opened completely without interfering with the door 390 of an adjacent locker to the right. Importantly, hinge 360 holds door 362 slightly away from housing 364 to allow additional venting of the interior, preferably $\frac{1}{8}^{th}$ inch. Rubber bumpers may be placed on the inside surface of door 362 to maintain this spacing and reduce the sound of door 362 being closed against housing 364.

Preferably, hinge 360 is a piano-type hinge that will maintain its alignment better and, together with housing connecting side 370, will minimize the risk of objects from getting caught in the present hinge 360. Most preferably, hinge 360 is a stacked series of piano hinge segments, each hinge segment of the stack having a pre-determined length corresponding to the distance between any two pre-selected heights at which dividers are supported by left and right walls 72, 74, all hinge segments being operated on a pair of steel pivot pins and each hinge in the series of hings segments being separated at its "knuckle" from the adjacent hinge segment in the series by two washers, that can be connected to (1) a single door, (2) two half-height doors, (3) three third-height doors, (4) four quarter-height doors, (5) five fifth-height doors, (6) six sixth-height doors or (7) two dual-height doors, so that the doors, regardless of height can be opened independently of each other. Thus, most preferably, the present hinge stack forms a universal hinge for 1, 2, 3, 4, 5, and 6 tier lockers.

For dual-height lockers, preferably, the hinge is located on the side of the door with the taller portion. Thus, there would be a hinge on both sides of a housing divided into two dual-height lockers, one hinge higher and one lower on the housing.

Figure 11:
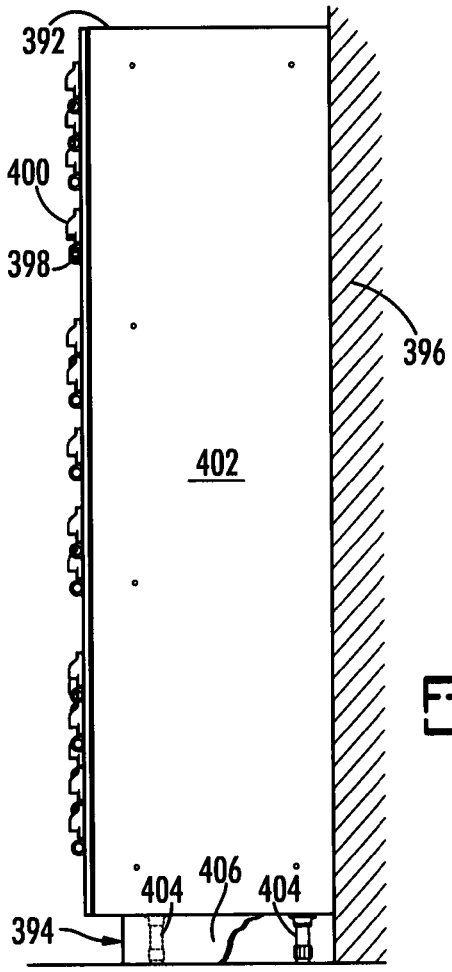
FIG. 11 is a side view of a locker system showing the end panel of a set of lockers and, in a partially cut-away portion of the base, the adjustable legs behind the toe kick board, according to a preferred embodiment of the present invention.

FIG. 11 shows a set of lockers 392 from the end with recessed base 394 mounted flush against a wall 396. Visible from the side are locking bars 398 for securing each door and lifting latches 400 for operating latch bars inside each locker. A decorative end panel 402 attached to the left wall and right wall of the endmost lockers is used to trim a row of the present lockers 392 and hide mortise and tenon joints. FIG. 11 also shows in a cutaway of base 394 the adjustable locker legs 404 behind a toe kick board 406.

Figure 12:
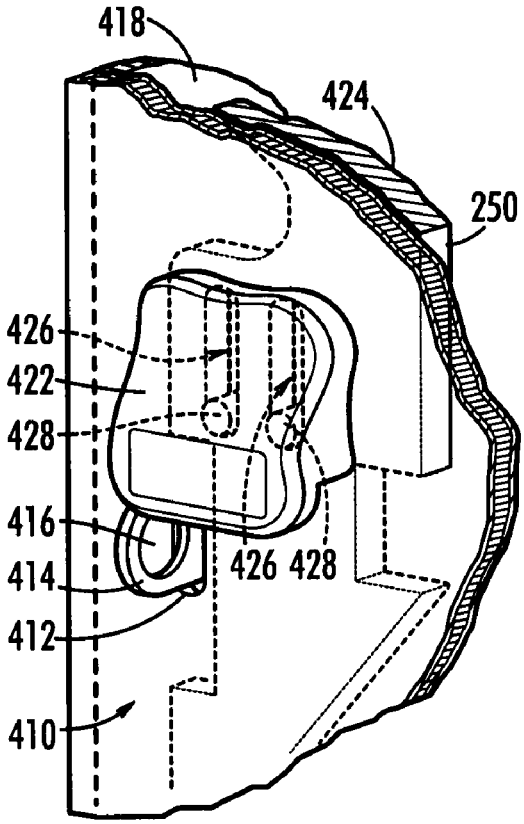
FIG. 12 is a detailed, perspective, exploded view of the latch mechanism from outside the locker door, according to a preferred embodiment of the present invention.
Figure 13:
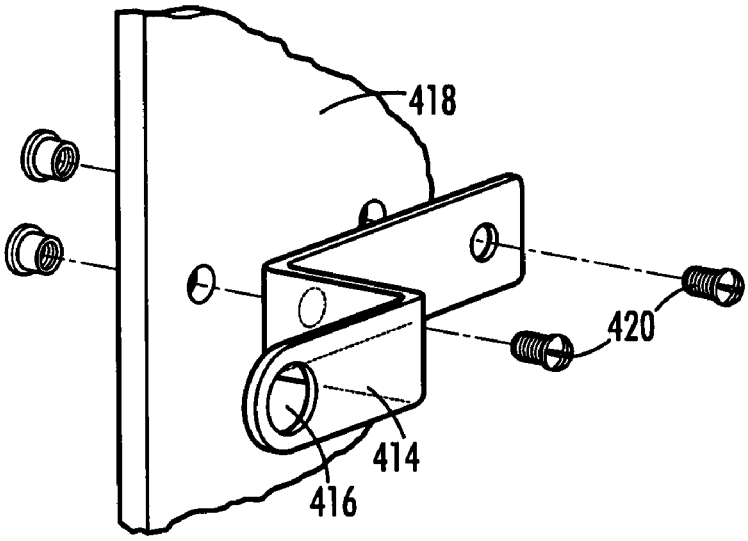
FIG. 13 is a detailed, perspective, exploded view of the latch mechanism with the door not shown, according to a preferred embodiment of the present invention.

FIGS. 12 and 13 show the user interface of the present locker. On the front of each door 410 is a slot 412 through which projects a locking bar 414 with a hole 416 formed therein for receiving the hasp of a lock (not shown) in order to secure door 410 and prevent it from being opened. Locking bar 414 is itself secured to a wall 418 of the locker.

A lifting latch 420 is mounted through holes formed in door 410 to the latch bar inside door 414 (see FIGS. 3 and 4) in order to permit latch bar to be lifted and thus, as it is lifted, urging lateral lock bars mounted to the inside of door 414 to slide from the latched to the unlatched positions, as described above. A plate 422 may be fitting to the front of the locker to carry the locker number if the locker is one in a set of lockers.

Figure 14:
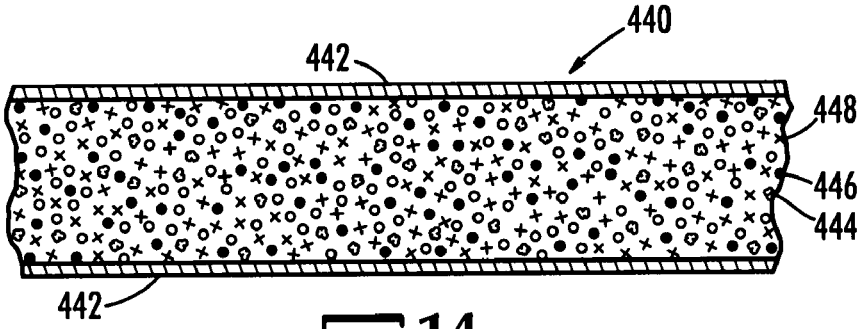
FIG. 14 is a detailed, cross sectional view of a panel taken along lines 14-14 of FIG. 7, showing the construction of a panel.

FIG. 14 illustrates a cross section of the material of which a locker panel (including) left wall, right wall, rear wall, top, bottom, divider, shelf and decorative end) are made. Panel 440 is made of a phenolic material, preferably polyenthylene or polypropylene, most preferably high density polyethylene. Preferably panel 440 is foamed to reduce weight, most preferably foamed with carbon dioxide. Panel 440 is impregnated with a fire retardant such as magnesium hydroxide to an extend at which it will meet fire code ratings for the environment of use. Panel 440 is impregnated with an antimicrobial agent or combination of agents such as zinc borate and/or silver dioxide to meet industrial standards. Hardware such as latches and hinges are preferably coated with an anti-microbial material. Panel 440 may alternatively be co-extruded with an anti-microbial agent on its outside surfaces 442 in the event panel 440 will not be cut to fit at the job site.

Preferably panel 440 is less than one inch thick; most preferably less than ½ inches thick.

Preferably all bolts visible from the exterior of the present locker are tamper proof, that is, they require a special tool to remove and cannot be removed with ordinary Phillips head or flat head screw drivers.

What is claimed is:

1. A locker system, comprising:

(a) a housing, said housing having
a left wall,
a right wall,
a rear wall,
a top, and
a bottom;

(b) at least one divider, said left wall, said right wall, said rear wall, said top and said bottom being formed to define an enclosure, said left wall and said right wall formed to receive said at least one divider at plural pre-selected heights between said top and said bottom so that any one divider of said at least one divider may be supported by said left and said right walls at any one of said plural preselected heights;

(c) at least two doors;

(d) a hinge pivotally connecting said at least two doors to said housing, said hinge being formed of a stack of hinge segments, the lengths of said hinge segments in said stack of hinge segments being approximately equal to the distances between said preselected heights to hingedly support doors of various heights, wherein said hinge holds said at least two doors slightly away from said housing when said at least two doors are closed to allow venting of the interior of said housing; and (e) a latch mechanism for holding said at least two doors to said housing.

2. The locker system as recited in claim 1, wherein said housing is formed to have plural vent holes.

3. The locker system as recited in claim 2, wherein said top and said bottom are formed to have plural vent holes.

4. The locker system as recited in claim 1, wherein said left wall, said right wall, said top and said bottom have grooves formed therein dimensioned to receive said rear wall.

5. The locker system as recited in claim 1, further comprising a decorative end panel attached to said right wall or said left wall.

6. The locker system as recited in claim 1, wherein said at least two doors includes a taller door and a shorter door.

7. The locker system as recited in claim 1, wherein said at least one divider further comprises an upper level, a lower level and a connector.

8. The locker system as recited in claim 1, wherein said left wall and said right wall are formed to have mortises at said preselected heights and said divider has tenons fitting in said mortises.

9. The locker system as recited in claim 1, further comprising adjustable legs supporting said bottom.

10. The locker system as recited in claim 9, further comprising a toe kick board surrounding said adjustable legs.

* * * * *